US010808424B2

(12) United States Patent
Criddle et al.

(10) Patent No.: US 10,808,424 B2
(45) Date of Patent: Oct. 20, 2020

(54) MODULAR MULTI-POINT LOCK

(71) Applicant: Amesbury Group, Inc., Amesbury, MA (US)

(72) Inventors: Douglas John Criddle, Sioux Falls, SD (US); Gary E. Tagtow, Sioux Falls, SD (US); Michael Lee Anderson, Sioux Falls, SD (US); Tracy Lammers, Sioux Falls, SD (US)

(73) Assignee: Amesbury Group, Inc., Amesbury, MA (US)

( * ) Notice: Subject to any disclaimer, the term of this patent is extended or adjusted under 35 U.S.C. 154(b) by 0 days.

(21) Appl. No.: 15/966,906

(22) Filed: Apr. 30, 2018

(65) Prior Publication Data

US 2018/0313116 A1 Nov. 1, 2018

Related U.S. Application Data

(60) Provisional application No. 62/492,761, filed on May 1, 2017.

(51) Int. Cl.
*E05B 63/14* (2006.01)
*E05B 47/00* (2006.01)
(Continued)

(52) U.S. Cl.
CPC ..... *E05B 63/143* (2013.01); *E05B 9/00* (2013.01); *E05B 9/002* (2013.01); *E05B 9/02* (2013.01);
(Continued)

(58) Field of Classification Search
CPC ..... E05B 9/002; E05B 47/00; E05B 47/0012; E05B 47/02; E05B 47/026; E05B 63/14;
(Continued)

(56) References Cited

U.S. PATENT DOCUMENTS 333,093 A 12/1885 Wright
419,384 A 1/1890 Towne
(Continued)

FOREIGN PATENT DOCUMENTS

AT 84928 12/1920
CA 2631521 11/2009
(Continued)

OTHER PUBLICATIONS

PCT International Search Report and Written Opinion in International Application PCT/US2018/030490, dated Jul. 26, 2018, 15 pgs.
(Continued)

*Primary Examiner* — Christopher J Boswell

(57) ABSTRACT

An electronic remote lock actuator includes a face plate defining a longitudinal axis. A housing disposed adjacent to the face plate. A motor disposed in the housing, and a first drive bar configured to be linearly moveable along the longitudinal axis by the motor. The first drive bar includes a first end and an opposite second end. The first end is configured to be secured to a second drive bar of a mechanical remote lock assembly such that linear movement of the first drive bar is translated to linear movement of the second drive bar along the longitudinal axis.

12 Claims, 10 Drawing Sheets

(51) Int. Cl.

| | |
|---|---|
| ***E05C 1/00*** | (2006.01) |
| ***E05B 9/00*** | (2006.01) |
| ***E05B 9/02*** | (2006.01) |
| ***E05C 9/20*** | (2006.01) |
| ***E05C 9/18*** | (2006.01) |
| ***E05B 47/02*** | (2006.01) |
| ***E05C 9/00*** | (2006.01) |

(52) U.S. Cl.
CPC ..... *E05B 47/0012* (2013.01); *E05B 47/02* (2013.01); *E05B 47/026* (2013.01); *E05C 1/00* (2013.01); *E05C 9/00* (2013.01); *E05C 9/1875* (2013.01); *E05C 9/20* (2013.01); *E05B 2047/0016* (2013.01); *E05B 2047/0023* (2013.01); *E05B 2047/0058* (2013.01); *E05B 2047/0069* (2013.01); *E05B 2047/0094* (2013.01); *E05B 2047/0095* (2013.01)

(58) Field of Classification Search
CPC ..... E05B 63/143; E05B 2047/000014; E05B 2047/0015; E05B 2047/0016; E05B 2047/0023; E05B 2047/0058; E05B 2047/0069; E05B 2047/0094; E05B 2047/0095; E05B 2047/0014; E05B 292/32–55
See application file for complete search history.

(56) References Cited

U.S. PATENT DOCUMENTS 651,947 A 6/1900 Johnson
738,280 A 9/1903 Bell et al.
932,330 A 8/1909 Rotchford
958,880 A 5/1910 Lawson
966,208 A 8/1910 Hoes
972,769 A 10/1910 Lark
980,131 A 12/1910 Shean
998,642 A 7/1911 Shean
1,075,914 A 10/1913 Hoes
1,094,143 A 4/1914 Hagstrom
1,142,463 A 6/1915 Shepherd
1,174,652 A 3/1916 Banks
1,247,052 A 11/1917 Wilson
1,251,467 A 1/1918 Blixt et al.
1,277,174 A 8/1918 Bakst
1,359,347 A 11/1920 Fleisher
1,366,909 A 2/1921 Frommer
1,368,141 A 2/1921 Hagstrom
1,529,085 A 3/1925 Preble
1,574,023 A 2/1926 Crompton et al.
1,596,992 A 8/1926 Ognowicz
1,646,674 A 10/1927 Angelillo
1,666,654 A 4/1928 Hiering
1,716,113 A 6/1929 Carlson
1,974,253 A 9/1934 Sandor
2,535,947 A 12/1950 Newell
2,729,089 A * 1/1956 Pelcin ..... E05B 47/0002 70/151 R
2,739,002 A 3/1956 Johnson
2,862,750 A 12/1958 Minke
2,887,336 A 5/1959 Meyer
2,905,493 A 9/1959 Tocchetto
3,064,462 A 11/1962 Ng et al.
3,083,560 A 4/1963 Scott
3,124,378 A 3/1964 Jackson
3,162,472 A 12/1964 Rust
3,214,947 A 11/1965 Wikkerink
3,250,100 A 5/1966 Cornaro
3,332,182 A 7/1967 Mark
3,378,290 A 4/1968 Sekulich
3,413,025 A 11/1968 Sperry
3,437,364 A 4/1969 Walters
RE26,677 E 10/1969 Russell et al.
3,498,657 A 3/1970 Fontana Giampiero
3,578,368 A 5/1971 Dupuis
3,586,360 A 6/1971 Perrotta
3,617,080 A 11/1971 Miller
3,670,537 A 6/1972 Horgan, Jr.
3,792,884 A 2/1974 Tutikawa
3,806,171 A 4/1974 Fernandez
3,899,201 A 8/1975 Paioletti
3,904,229 A 9/1975 Waldo
3,919,808 A 11/1975 Simmons
3,940,886 A 3/1976 Ellingson, Jr.
3,953,061 A 4/1976 Hansen et al.
4,076,289 A 2/1978 Fellows et al.
4,116,479 A 9/1978 Poe
4,130,306 A 12/1978 Brkic
4,132,438 A 1/1979 Guymer
4,146,994 A 4/1979 Williams
4,236,396 A 12/1980 Surko et al.
4,273,368 A 6/1981 Tanaka
4,283,882 A 8/1981 Hubbard
4,288,944 A 9/1981 Donovan
4,362,328 A 12/1982 Tacheny
4,365,490 A 12/1982 Manzoni
4,372,594 A 2/1983 Gater
4,476,700 A 10/1984 King
4,500,122 A 2/1985 Douglas
4,547,006 A 10/1985 Castanier
4,548,432 A 10/1985 Bengtsson
4,593,542 A 6/1986 Rotondi et al.
4,595,220 A 6/1986 Hatchett, Jr.
4,602,490 A 7/1986 Glass
4,602,812 A 7/1986 Bourner
4,607,510 A 8/1986 Shanaan et al.
4,639,025 A 1/1987 Fann
4,643,005 A 2/1987 Logas
4,691,543 A 9/1987 Watts
4,704,880 A 11/1987 Schlindwein
4,717,909 A 1/1988 Davis
4,754,624 A 7/1988 Fleming et al.
4,768,817 A 9/1988 Fann
4,893,849 A 1/1990 Schlack
4,913,475 A * 4/1990 Bushnell ..... E05B 47/026 292/144
4,949,563 A * 8/1990 Gerard ..... E05B 47/026 70/279.1
4,961,602 A 10/1990 Pettersson
4,962,653 A 10/1990 Kaup
4,962,800 A 10/1990 Owiriwo
4,964,660 A 10/1990 Prevot et al.
4,973,091 A 11/1990 Paulson
5,077,992 A 1/1992 Su
5,092,144 A 3/1992 Fleming et al.
5,114,192 A 5/1992 Toledo
5,118,151 A 6/1992 Nicholas, Jr. et al.
5,125,703 A 6/1992 Clancy et al.
5,148,691 A * 9/1992 Wallden ..... E05B 47/0012 70/279.1
5,171,050 A 12/1992 Mascotte
5,172,944 A 12/1992 Munich et al.
5,184,852 A 2/1993 O'Brien
5,193,861 A 3/1993 Juga
5,197,771 A 3/1993 Kaup et al.
5,257,841 A 11/1993 Geringer
5,265,452 A 11/1993 Dawson et al.
5,290,077 A 3/1994 Fleming
5,364,138 A 11/1994 Dietrich
5,373,716 A 12/1994 MacNeil et al.
5,382,060 A 1/1995 O'Toole et al.
5,388,875 A 2/1995 Fleming
5,394,718 A * 3/1995 Hotzl ..... E05B 47/0012 292/144
5,404,737 A * 4/1995 Hotzl ..... E05B 47/0012 292/144
5,456,503 A 10/1995 Russell et al.
5,482,334 A 1/1996 Hotzl
5,495,731 A 3/1996 Riznik
5,496,082 A 3/1996 Zuckerman
5,498,038 A 3/1996 Simon
5,513,505 A 5/1996 Danes

(56) References Cited

U.S. PATENT DOCUMENTS 5,516,160 A 5/1996 Kajuch
5,524,941 A 6/1996 Fleming
5,524,942 A 6/1996 Fleming
5,544,924 A 8/1996 Paster
5,603,534 A 2/1997 Fuller
5,609,372 A 3/1997 Ponelle
5,620,216 A 4/1997 Fuller
5,707,090 A 1/1998 Sedley
5,716,154 A 2/1998 Miller et al.
5,722,704 A 3/1998 Chaput et al.
5,728,108 A 3/1998 Griffiths et al.
5,735,559 A 4/1998 Frolov
5,757,269 A 5/1998 Roth
5,782,114 A 7/1998 Zeus et al.
5,791,700 A 8/1998 Biro
5,820,170 A 10/1998 Clancy
5,820,173 A 10/1998 Fuller
5,825,288 A 10/1998 Wojdan
5,865,479 A 2/1999 Viney
5,878,606 A 3/1999 Chaput et al.
5,890,753 A 4/1999 Fuller
5,896,763 A 4/1999 Dinkelborg et al.
5,901,989 A 5/1999 Becken et al.
5,906,403 A 5/1999 Bestler et al.
5,911,763 A 6/1999 Quesada
5,915,764 A 6/1999 MacDonald
5,918,916 A 7/1999 Kajuch
5,946,956 A 9/1999 Hotzl
5,951,068 A 9/1999 Strong et al.
6,050,115 A 4/2000 Schroter et al.
6,079,585 A 6/2000 Lentini
6,094,869 A 8/2000 Magoon et al.
6,098,433 A 8/2000 Manaici
6,112,563 A * 9/2000 Ramos ..... G07C 9/00111 292/144
6,120,071 A 9/2000 Picard
D433,916 S 11/2000 Frey
6,148,650 A 11/2000 Kibble
6,174,004 B1 1/2001 Picard et al.
6,196,599 B1 3/2001 D'Hooge
6,209,931 B1 4/2001 Von Stoutenborough et al.
6,217,087 B1 4/2001 Fuller
6,250,842 B1 6/2001 Kruger
6,257,030 B1 7/2001 Davis, III et al.
6,264,252 B1 7/2001 Clancy
6,266,981 B1 7/2001 von Resch et al.
6,282,929 B1 9/2001 Eller et al.
6,283,516 B1 9/2001 Viney
6,293,598 B1 9/2001 Rusiana
6,318,769 B1 11/2001 Kang
6,327,881 B1 12/2001 Grundler et al.
6,389,855 B2 5/2002 Renz et al.
6,441,735 B1 8/2002 Marko
6,443,506 B1 9/2002 Su
6,453,616 B1 9/2002 Wright
6,454,322 B1 9/2002 Su
6,457,751 B1 10/2002 Hartman
6,490,895 B1 12/2002 Weinerman
6,502,435 B2 1/2003 Watts et al.
6,516,641 B1 2/2003 Segawa
6,540,268 B2 4/2003 Pauser
6,564,596 B2 5/2003 Huang
6,568,726 B1 5/2003 Caspi
6,580,355 B1 6/2003 Milo
6,619,085 B1 9/2003 Hsieh
6,637,784 B1 10/2003 Hauber
6,672,632 B1 1/2004 Speed et al.
6,688,656 B1 2/2004 Becken
6,733,051 B1 5/2004 Cowper
6,776,441 B2 8/2004 Liu
6,810,699 B2 11/2004 Nagy
6,813,916 B2 * 11/2004 Chang ..... E05B 47/0012 292/144
6,871,451 B2 3/2005 Harger et al.
6,905,152 B1 6/2005 Hudson
6,929,293 B2 8/2005 Tonges
6,935,662 B1 8/2005 Hauber et al.
6,962,377 B2 11/2005 Tonges
6,971,686 B2 * 12/2005 Becken ..... E05B 63/20 292/142
6,994,383 B2 2/2006 Morris
7,000,959 B2 2/2006 Sanders
7,010,945 B2 3/2006 Yu
7,010,947 B2 3/2006 Milo
7,025,394 B1 4/2006 Hunt
7,032,418 B2 4/2006 Martin
7,083,206 B1 8/2006 Johnson
7,128,350 B2 10/2006 Eckerdt
7,155,946 B2 1/2007 Lee et al.
7,203,445 B2 4/2007 Uchida
7,207,199 B2 4/2007 Smith et al.
7,249,791 B2 7/2007 Johnson
7,261,330 B1 8/2007 Hauber
7,353,637 B2 4/2008 Harger et al.
7,404,306 B2 * 7/2008 Walls ..... E05C 9/20 292/139
7,410,194 B2 8/2008 Chen
7,418,845 B2 9/2008 Timothy
7,513,540 B2 4/2009 Hagemeyer et al.
7,526,933 B2 5/2009 Meekma
7,634,928 B2 12/2009 Hunt
7,637,540 B2 12/2009 Chiang
7,677,067 B2 3/2010 Riznik et al.
7,686,207 B1 3/2010 Jeffs
7,707,862 B2 5/2010 Walls et al.
7,726,705 B2 6/2010 Kim
7,735,882 B2 6/2010 Abdollahzadeh et al.
7,748,759 B2 7/2010 Chen
7,856,856 B2 12/2010 Shvartz
7,878,034 B2 2/2011 Alber et al.
7,946,080 B2 5/2011 Ellerton
7,963,573 B2 6/2011 Blomqvist
8,161,780 B1 4/2012 Huml
8,182,002 B2 5/2012 Fleming
8,325,039 B2 12/2012 Picard
8,348,308 B2 1/2013 Hagemeyer et al.
8,376,414 B2 2/2013 Nakanishi et al.
8,376,415 B2 2/2013 Uyeda
8,382,166 B2 2/2013 Hagemeyer et al.
8,382,168 B2 2/2013 Carabalona
8,398,126 B2 * 3/2013 Nakanishi ..... E05B 63/185 292/1.5
8,403,376 B2 3/2013 Greiner
8,494,680 B2 * 7/2013 Sparenberg ..... E05B 47/026 700/275
8,550,506 B2 10/2013 Nakanishi
8,567,631 B2 10/2013 Brunner
8,628,126 B2 1/2014 Hagemeyer et al.
8,646,816 B2 2/2014 Dziurdzia
8,839,562 B2 9/2014 Madrid
8,840,153 B2 9/2014 Juha
8,850,744 B2 10/2014 Bauman et al.
8,851,532 B2 10/2014 Gerninger
8,876,172 B2 * 11/2014 Denison ..... E05B 47/0012 292/144
8,899,635 B2 12/2014 Nakanishi
8,922,370 B2 12/2014 Picard
8,939,474 B2 1/2015 Hagemeyer et al.
9,428,937 B2 8/2016 Tagtow et al.
9,482,035 B2 11/2016 Wolf
9,512,654 B2 * 12/2016 Armari ..... E05B 47/0012
9,605,444 B2 3/2017 Rickenbaugh
9,637,957 B2 * 5/2017 Hagemeyer ..... E05C 1/004
9,758,997 B2 9/2017 Hagemeyer et al.
9,765,550 B2 9/2017 Hemmingsen et al.
9,790,716 B2 * 10/2017 Hagemeyer ..... E05B 65/0858
9,822,552 B2 * 11/2017 Eller ..... E05B 47/0012
10,240,366 B2 * 3/2019 Sotes Delgado ... E05B 47/0012
10,246,914 B2 4/2019 Sieglaar
2002/0104339 A1 * 8/2002 Saner ..... E05B 65/1086 70/108
2003/0024288 A1 2/2003 Gokcebay et al.
2003/0159478 A1 8/2003 Nagy
2004/0004360 A1 1/2004 Huang

(56) References Cited

U.S. PATENT DOCUMENTS

| | | | |
|---|---|---|---|
| 2004/0011094 | A1 | 1/2004 | Hsieh |
| 2004/0066046 | A1 | 4/2004 | Becken |
| 2004/0089037 | A1 | 5/2004 | Chang |
| 2004/0107746 | A1 | 6/2004 | Chang |
| 2004/0107747 | A1 | 6/2004 | Chang |
| 2004/0112100 | A1 | 6/2004 | Martin |
| 2004/0145189 | A1 | 7/2004 | Liu |
| 2004/0227349 | A1 | 11/2004 | Denys |
| 2004/0239121 | A1 | 12/2004 | Morris |
| 2005/0029345 | A1 | 2/2005 | Waterhouse |
| 2005/0044908 | A1 | 3/2005 | Min |
| 2005/0050928 | A1 | 3/2005 | Frolov |
| 2005/0103066 | A1 | 5/2005 | Botha et al. |
| 2005/0144848 | A1 | 7/2005 | Harger et al. |
| 2005/0166647 | A1 | 8/2005 | Walls |
| 2005/0180562 | A1 | 8/2005 | Chiang |
| 2005/0229657 | A1 | 10/2005 | Johansson et al. |
| 2006/0043742 | A1 | 3/2006 | Huang |
| 2006/0071478 | A1 | 4/2006 | Denys |
| 2006/0076783 | A1 | 4/2006 | Tsai |
| 2006/0150516 | A1 | 7/2006 | Hagemeyer |
| 2006/0208509 | A1 | 9/2006 | Bodily |
| 2007/0068205 | A1 | 3/2007 | Timothy |
| 2007/0080541 | A1 | 4/2007 | Fleming |
| 2007/0113603 | A1 | 5/2007 | Polster |
| 2007/0170725 | A1 | 7/2007 | Speyer et al. |
| 2007/0259551 | A1 | 11/2007 | Rebel |
| 2008/0000276 | A1 | 1/2008 | Huang |
| 2008/0001413 | A1 | 1/2008 | Lake |
| 2008/0087052 | A1 | 4/2008 | Abdollahzadeh et al. |
| 2008/0092606 | A1 | 4/2008 | Meekma |
| 2008/0093110 | A1 | 4/2008 | Bagung |
| 2008/0141740 | A1 | 6/2008 | Shvartz |
| 2008/0150300 | A1 | 6/2008 | Harger et al. |
| 2008/0156048 | A1 | 7/2008 | Topfer |
| 2008/0156049 | A1 | 7/2008 | Topfer |
| 2008/0157544 | A1 | 7/2008 | Phipps |
| 2008/0178530 | A1 | 7/2008 | Ellerton et al. |
| 2008/0179893 | A1 | 7/2008 | Johnson |
| 2008/0184749 | A1 | 8/2008 | Alber et al. |
| 2008/0191499 | A1 | 8/2008 | Stein |
| 2009/0064737 | A1 | 3/2009 | Fan |
| 2009/0078011 | A1 | 3/2009 | Avni |
| 2009/0218832 | A1 | 9/2009 | Mackle |
| 2009/0314042 | A1 | 12/2009 | Fan |
| 2009/0315669 | A1 | 12/2009 | Lang |
| 2010/0107707 | A1 | 5/2010 | Viviano |
| 2010/0154490 | A1 | 6/2010 | Hagemeyer et al. |
| 2010/0213724 | A1 | 8/2010 | Uyeda |
| 2010/0236302 | A1 | 9/2010 | Uyeda |
| 2010/0313612 | A1 | 12/2010 | Eichenstein |
| 2010/0327610 | A1 | 12/2010 | Nakanishi et al. |
| 2011/0056254 | A1 | 3/2011 | Tsai |
| 2011/0198867 | A1 | 8/2011 | Hagemeyer et al. |
| 2011/0289987 | A1 | 12/2011 | Chiou et al. |
| 2011/0314877 | A1 | 12/2011 | Fang |
| 2012/0001443 | A1 | 1/2012 | Mitchell |
| 2012/0146346 | A1 | 6/2012 | Hagemeyer et al. |
| 2012/0235428 | A1 | 9/2012 | Blacklaws et al. |
| 2012/0306220 | A1 | 12/2012 | Hagemeyer et al. |
| 2013/0019643 | A1 | 1/2013 | Tagtow et al. |
| 2013/0081251 | A1 | 4/2013 | Hultberg |
| 2013/0140833 | A1 | 6/2013 | Hagemeyer et al. |
| 2013/0152647 | A1 | 6/2013 | Terei et al. |
| 2013/0200636 | A1 | 8/2013 | Hagemeyer et al. |
| 2013/0234449 | A1 | 9/2013 | Dery et al. |
| 2013/0276488 | A1 | 10/2013 | Haber |
| 2014/0060127 | A1 | 3/2014 | Hemmingsen et al. |
| 2014/0125068 | A1 | 5/2014 | Hagemeyer et al. |
| 2014/0159387 | A1 | 6/2014 | Hagemeyer et al. |
| 2014/0182343 | A1 | 7/2014 | Talpe |
| 2014/0367978 | A1 | 12/2014 | Geringer |
| 2015/0075233 | A1 | 3/2015 | Pluta |
| 2015/0089804 | A1 | 4/2015 | Picard |
| 2015/0114176 | A1 | 4/2015 | Bisang |
| 2015/0170449 | A1 | 6/2015 | Chandler, Jr. |
| 2015/0176311 | A1 | 6/2015 | Picard |
| 2015/0252595 | A1 | 9/2015 | Hagemeyer et al. |
| 2016/0083976 | A1 | 3/2016 | Rickenbaugh |
| 2016/0108650 | A1 | 4/2016 | Hagemeyer et al. |
| 2016/0369525 | A1 | 12/2016 | Tagtow et al. |
| 2018/0023320 | A1 | 1/2018 | McKibben |
| 2018/0051478 | A1 | 2/2018 | Tagtow |
| 2018/0051480 | A1 | 2/2018 | Tagtow |
| 2018/0119462 | A1 | 5/2018 | Hagemeyer |
| 2018/0155962 | A1* | 6/2018 | Mitchell ..... E05C 9/042 |
| 2018/0298642 | A1 | 10/2018 | Tagtow |
| 2019/0024437 | A1 | 1/2019 | Tagtow |
| 2019/0032368 | A1* | 1/2019 | Welbig ..... E05B 47/0012 |
| 2019/0277062 | A1 | 9/2019 | Tagtow |

FOREIGN PATENT DOCUMENTS

| | | | |
|---|---|---|---|
| CN | 1243908 | | 2/2000 |
| CN | 2554288 | Y | 6/2003 |
| CN | 2595957 | Y | 12/2003 |
| CN | 2660061 | | 12/2004 |
| CN | 201031548 | Y | 3/2008 |
| CN | 202047652 | U | 11/2011 |
| DE | 1002656 | | 2/1957 |
| DE | 1584112 | | 9/1969 |
| DE | 2639065 | | 3/1977 |
| DE | 3032086 | | 3/1982 |
| DE | 3836693 | | 5/1990 |
| DE | 9011216 | | 10/1990 |
| DE | 4224909 | | 2/1993 |
| DE | 29807860 | | 8/1998 |
| DE | 20115378 | U1 | 11/2001 |
| DE | 10253240 | | 5/2004 |
| DE | 202012002743 | U1 | 4/2012 |
| DE | 202013000920 | U1 | 4/2013 |
| DE | 202013000921 | U1 | 4/2013 |
| DE | 202013001328 | U1 | 5/2013 |
| EP | 0007397 | A1 | 2/1980 |
| EP | 0231042 | A2 | 8/1987 |
| EP | 268750 | | 6/1988 |
| EP | 341173 | | 11/1989 |
| EP | 359284 | | 3/1990 |
| EP | 661409 | | 7/1995 |
| EP | 792987 | | 9/1997 |
| EP | 1106761 | | 6/2001 |
| EP | 1283318 | | 2/2003 |
| EP | 1449994 | | 8/2004 |
| EP | 1574642 | | 9/2005 |
| EP | 1867817 | | 12/2007 |
| EP | 2128362 | | 12/2009 |
| EP | 2273046 | A2 | 1/2011 |
| EP | 2339099 | A1 | 6/2011 |
| EP | 2450509 | | 5/2012 |
| EP | 2581531 | A1 | 4/2013 |
| EP | 2584123 | A1 | 4/2013 |
| EP | 2584124 | A2 | 4/2013 |
| EP | 2998483 | | 3/2016 |
| EP | 3091152 | A1 | 11/2016 |
| FR | 363424 | | 7/1906 |
| FR | 370890 | | 2/1907 |
| FR | 21883 | E | 4/1921 |
| FR | 1142316 | | 3/1957 |
| FR | 1162406 | A | 9/1958 |
| FR | 1201087 | | 12/1959 |
| FR | 2339723 | | 9/1977 |
| FR | 2342390 | | 9/1977 |
| FR | 2344695 | | 10/1977 |
| FR | 2502673 | | 10/1982 |
| FR | 2848593 | | 2/2005 |
| FR | 3017641 | | 8/2015 |
| GB | 226170 | | 4/1925 |
| GB | 264373 | A | 1/1927 |
| GB | 583655 | | 12/1946 |
| GB | 612094 | A | 11/1948 |
| GB | 1498849 | | 1/1978 |
| GB | 1575900 | | 10/1980 |
| GB | 2051214 | | 1/1981 |
| GB | 2076879 | | 12/1981 |

(56) References Cited

FOREIGN PATENT DOCUMENTS

| | | | |
|---|---|---|---|
| GB | 2115055 | A | 9/1983 |
| GB | 2122244 | | 1/1984 |
| GB | 2126644 | | 3/1984 |
| GB | 2134170 | | 8/1984 |
| GB | 2136045 | | 9/1984 |
| GB | 2168747 | | 6/1986 |
| GB | 2196375 | | 4/1988 |
| GB | 2212849 | | 8/1989 |
| GB | 2225052 | | 5/1990 |
| GB | 2230294 | | 10/1990 |
| GB | 2242702 | | 10/1991 |
| GB | 2244512 | | 12/1991 |
| GB | 2265935 | | 10/1993 |
| GB | 2270343 | | 3/1994 |
| GB | 2280474 | | 2/1995 |
| GB | 2318382 | A | 4/1998 |
| GB | 2364545 | | 1/2002 |
| GB | 2496911 | A | 5/2013 |
| IT | 614960 | | 1/1961 |
| JP | 64-083777 | | 3/1989 |
| JP | 2003343141 | | 12/2003 |
| JP | 2006112042 | | 4/2006 |
| JP | 2008002203 | | 1/2008 |
| KR | 2011094706 | | 8/2011 |
| NL | 8105627 | | 7/1983 |
| SE | 309372 | | 3/1969 |
| WO | 96/25576 | | 8/1996 |
| WO | 02/33202 | | 4/2002 |
| WO | 2007/104499 | | 9/2007 |
| WO | 2010071886 | | 6/2010 |
| WO | 2015/079290 | | 6/2015 |

OTHER PUBLICATIONS

"Intercity Locks—For All Your Security Needs—Fast", http://www.directlocks.co.uk/locks-multipoint-locks-c-123_96.html, accessed Oct. 27, 2011, original publication date unknown, 3 pgs.

"Intercity Locks—For All Your Security Needs—Fast", http://www.directlocks.co.uk/locks-multipoint-locks-c-123_96.html?page=2&sort=2A, accessed Oct. 27, 2011, original publication date unknown, 3 pgs.

"Intercity Locks—For All Your Security Needs—Fast", http://www.directlocks.co.uk/locks-multipoint-locks-c-123_96.html?page=3&sort=2A, accessed Oct. 27, 2011, original publication date unknown, 3 pgs.

"LocksOnline.co.uk: Premier Supplier of Security Products", http://www.locksonline.co.uk/acatalog/Maco_multipoint_lock_2_cams_2_shootbolt_attachment.html, accessed Oct. 27, 2011, original publication date unknown, 5 pgs.

"LocksOnline.co.uk: Premier Supplier of Security Products", http://www.locksonline.co.uk/acatalog/upvc_Locks.html, accessed Oct. 27, 2011, original publication date unknown, 6 pgs.

"uPVC Window Hardware and uPVC Door Hardware online", http://www.upvc-hardware.co.uk/, accessed Oct. 27, 2011, original publication date unknown, 2 pgs.

Doorking.com—Electric Locks—Strikes and Deadbolts; printed from https://www.doorking.com/access- control/electricocks-strikes-deadbolts, 2 pages, Feb. 2016.

magneticlocks.net—Electric Strikes and Deadbolts; printed from https://www.magneticlocks.net/electric-strikes-and-deadbolts/electric-strikes.html, 8 pages, Feb. 2016.

sdcsecurity.com—Latch and Deadbolt Monitoring Strikes; printed from http://www.sdcsecurity.com/monitor-strike-kits2.htm, 2 pages, Feb. 2016.

* cited by examiner

MODULAR MULTI-POINT LOCK

CROSS-REFERENCE TO RELATED APPLICATIONS

This application claims priority to and the benefit of U.S. Provisional Patent Application No. 62/492,761, filed on May 1, 2017, the disclosure of which is hereby incorporated herein by reference in its entirety.

INTRODUCTION

Some known multi-point locks are installed on a locking edge of a door and extend above and/or below a handle and main locking assembly. These multi-point locks add extra security and may help keep the door from warping over time as they add another contact point into the surrounding door frame, head, or sill. However, as doors are manufactured in a wide variety of heights and handle locations, the mechanical linkage between the main locking assemblies and the remote locking assemblies need to accommodate the varying door heights and handle locations.

SUMMARY

In an aspect, the technology relates to an electronic remote lock actuator including: a face plate defining a longitudinal axis; a housing disposed adjacent to the face plate; a motor disposed in the housing; and a first drive bar configured to be linearly moveable along the longitudinal axis by the motor, wherein the first drive bar includes a first end and an opposite second end, and wherein the first end is configured to be secured to a second drive bar of a mechanical remote lock assembly such that linear movement of the first drive bar is translated to linear movement of the second drive bar along the longitudinal axis.

In an example, the electronic remote lock actuator further includes a nut coupled to the second end of the first drive bar and a leadscrew coupled to the motor, wherein the nut is threadably engaged with the leadscrew such that upon rotation of the leadscrew by the motor, the first drive bar linearly moves along the longitudinal axis. In another example, a rotational axis of the leadscrew is substantially parallel to the longitudinal axis. In yet another example, the electronic remote lock actuator further includes a battery carrier configured to contain a power source, wherein the batter carrier is removably disposable within the housing. In still another example, the electronic remote lock actuator further includes a coupler assembly configured to secure the first drive bar to the second drive bar, wherein the first drive bar is adjacent to the second drive bar along the longitudinal axis.

In an example, the coupler assembly includes at least one rack configured to secure the first end of the first drive bar and at least one projection configured to secure the second drive bar. In another example, the mechanical remote lock assembly includes at least one of a flipper extension, a shoot bolt extension, a rhino hook extension, and a deadbolt extension. In yet another example, the first drive bar is unitary with the second drive bar. In still another example, the motor includes a rotatory motor, and wherein rotational movement of the rotatory motor is configured to be translated into linear movement of the drive bar.

In another aspect, the technology relates to a remote lock system including: a drive bar defining a longitudinal axis; an electronic actuator including a motor configured to linearly move the drive bar along the longitudinal axis; and a mechanical remote lock assembly coupled to the drive bar, wherein upon linear movement of the drive bar by the motor, the mechanical remote lock assembly actuates between a lock position and an unlock position.

In an example, the electronic actuator further includes: a face plate; and a housing disposed adjacent to the face plate, wherein the motor is disposed within the housing and at least a portion of the drive bar extends from the housing. In another example, the electronic actuator further includes: a leadscrew coupled to the motor and rotatable about a rotational axis by the motor; and a nut threadably engaged with the leadscrew and coupled to the drive bar, wherein upon rotation of the leadscrew by the motor, the drive bar linearly moves along the longitudinal axis via the nut. In yet another example, the rotational axis is substantially parallel to the longitudinal axis. In still another example, the electronic actuator further includes a removable power source.

In an example, the drive bar includes a first drive bar coupled to the motor and a second drive bar coupled to the mechanical remote lock assembly, and wherein the first drive bar is adjacent to the second drive bar along the longitudinal axis. In another example, the remote lock system further includes a coupler assembly configured to secure the first drive bar to the second drive bar. In yet another example, the coupler assembly includes at least one rack configured to secure to the first drive bar and at least one projection configured to secure to the second drive bar. In still another example, the mechanical remote lock assembly includes at least one of a flipper extension, a shoot bolt extension, a rhino hook extension, and a deadbolt extension.

In another aspect, the technology relates to a method of actuating a mechanical remote lock assembly, the method including: rotating a leadscrew via a motor, wherein a drive bar is coupled to the leadscrew by a threaded nut; in combination with rotating the leadscrew, linearly moving the drive bar along a longitudinal axis, wherein the drive bar is coupled to the mechanical remote lock assembly; and selectively positioning the mechanical remote lock assembly between a lock position and an unlock position via linear movement of the drive bar.

In an example, the method further includes signaling the motor to drive rotation of the leadscrew upon detection of a deadbolt relative to a keeper sensor.

BRIEF DESCRIPTION OF THE DRAWINGS

There are shown in the drawings, examples which are presently preferred, it being understood, however, that the technology is not limited to the precise arrangements and instrumentalities shown.

DETAILED DESCRIPTION

Figure 1:
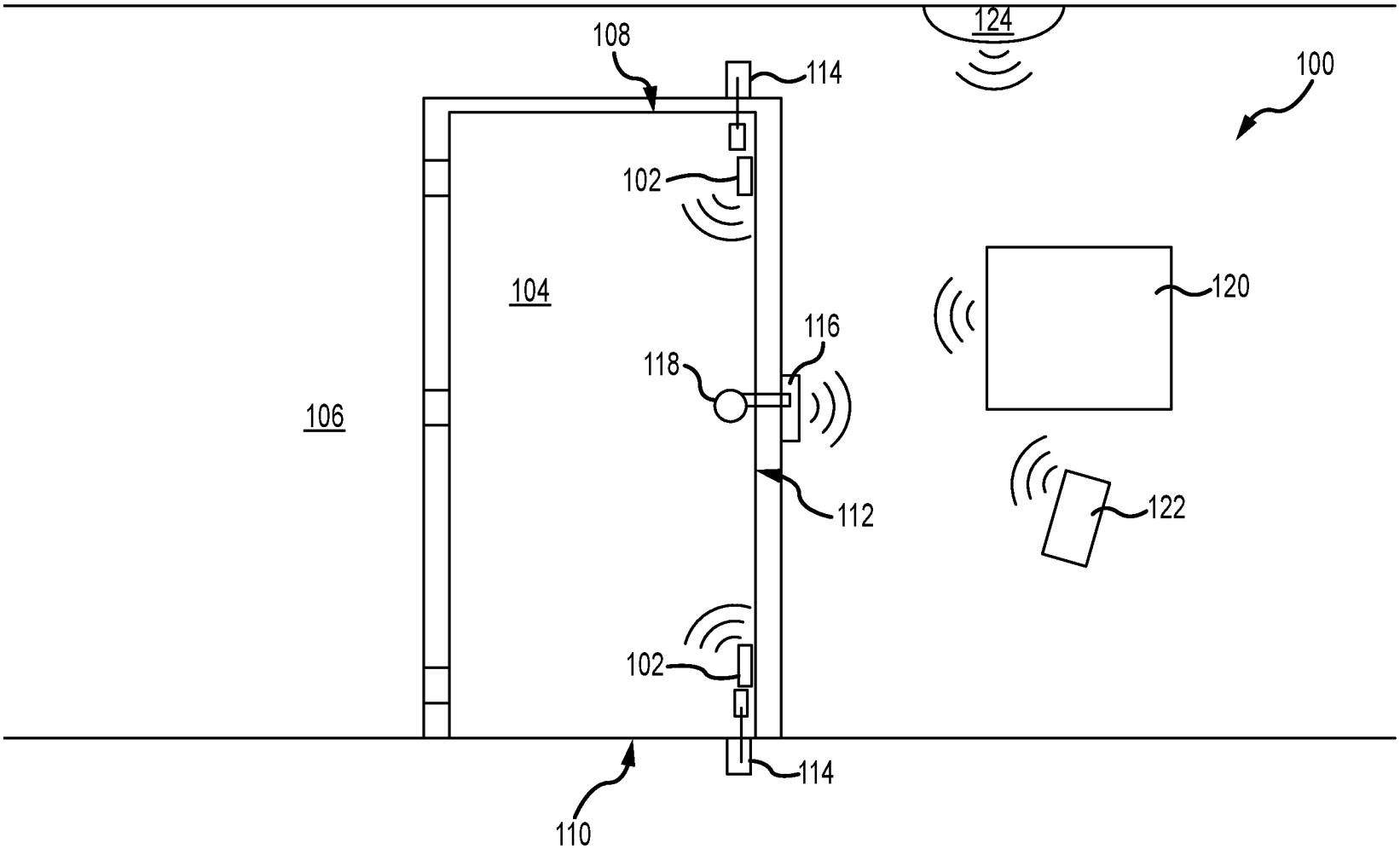
FIG. 1 depicts a schematic view of an electronic door lock system.

FIG. 1 depicts a schematic view of one example of a multi-point electric door lock system 100. The system 100 includes two electronic remote lock systems 102 installed in a door panel 104, for example, so as to extend into a portion of a frame 106, such as a head and/or a sill thereof. Alternatively, the electronic remote lock systems 102 may be installed in the frame 106 so as to extend into the door 104. Additionally, the placement and number of the electronic remote lock systems 102 may be altered as required or desired for a particular application, for example, in pivoting doors, the electronic remote lock systems may be disposed so as to extend from a head 108, a sill 110, or a locking edge 112 (e.g., vertical edge) of the door 104.

In the example, the door panel 104 is a pivoting door; however, the electronic remote lock systems described herein can be utilized in entry doors, sliding doors, pivoting patio doors, and any other door as required or desired. In sliding patio doors, the electronic remote lock systems 102 have linearly extending locking elements that may extend from the head 108 or the sill 110 of the sliding door. If utilized on the locking edge 112 of a sliding door, the electronic remote lock system 102 would require a hook-shaped locking element (e.g., a rhino-bolt) that would hook about a keeper so as to prevent retraction of the door 104. Examples of various locking elements are described further below in reference to FIGS. 7A-8C.

In the example, each electronic remote lock system 102 is positioned to extend into a keeper 114. The keepers 114 may be standard keepers or electronic keepers as described in U.S. patent application Ser. No. 15/239,714, filed Aug. 17, 2016, entitled "Locking System Having an Electronic Keeper," the disclosure of which is hereby incorporated by reference in its entirety herein. The system 100 also includes an electronic keeper 116 configured to receive a standard (e.g., manually-actuated) deadbolt 118, as typically available on an entry or patio door.

In one example, once the deadbolt 118 is manually actuated into the locking position, the electronic keeper 116 detects a position of the deadbolt 118 therein. A signal may be sent to the remotely located electronic remote lock systems 102, thus causing actuation thereof. At this point, the door 104 is now locked at multiple points. Unlocking of the manual deadbolt 118 is detected by the electronic keeper 116 (that is, the keeper 116 no longer detects the presence of the deadbolt 118 therein) and a signal is sent to the electronic remote lock systems 102 causing retraction thereof, thus allowing the door 104 to be opened. Thus, the electronic remote lock systems described herein may be utilized to create a robust multi-point locking system for a door and to improve the security thereof.

In another example, the system 100 may include a controller/monitoring system, which may be a remote panel 120, which may be used to extend or retract the electronic remote lock systems 102, or which may be used for communication between the various electronic keepers 114 and multi-point remote lock systems 102. Alternatively or additionally, an application on a remote computer or smartphone 122 may take the place of, or supplement, the remote panel 120. By utilizing a remote panel 120 and/or a smartphone 122, the electronic remote lock systems 102 may be locked or unlocked remotely, thus providing multi-point locking ability without the requirement for manual actuation of the deadbolt 118. Additionally, any or all of the components (electronic remote lock systems 102, keeper 116, panel 120, and smartphone 122) may communicate either directly or indirectly with a home monitoring or security system 124. The communication between components may be wireless, as depicted, or may be via wired systems.

The electronic remote lock systems described herein allow for a single versatile electronic actuator to be used with a variety of mechanical remote locks. As such, installation and manufacture of multi-point lock systems are significantly simplified. For example, the mechanical linkages between the main lock assembly and the remote locks are eliminated, thus allowing doors having different heights and handle locations to be easily accommodated. The main lock assembly can trigger remote actuation of the remote locks via the electronic actuator. The same electronic actuator may be used in a variety of doors, thus reducing the number of different parts required for the system. In one aspect, the electronic actuator includes a motor configured to couple to and actuate a drive bar of a mechanical remote lock. As such, the electronic actuator may be used with a wide variety of door types and remote lock configurations such as deadbolts, rhino bolts, shoot bolts, flippers, etc. Additionally, the use of a single electronic actuator enables the multi-point lock systems to be configured in the field without any specialized tools or additional parts.

Figure 2:
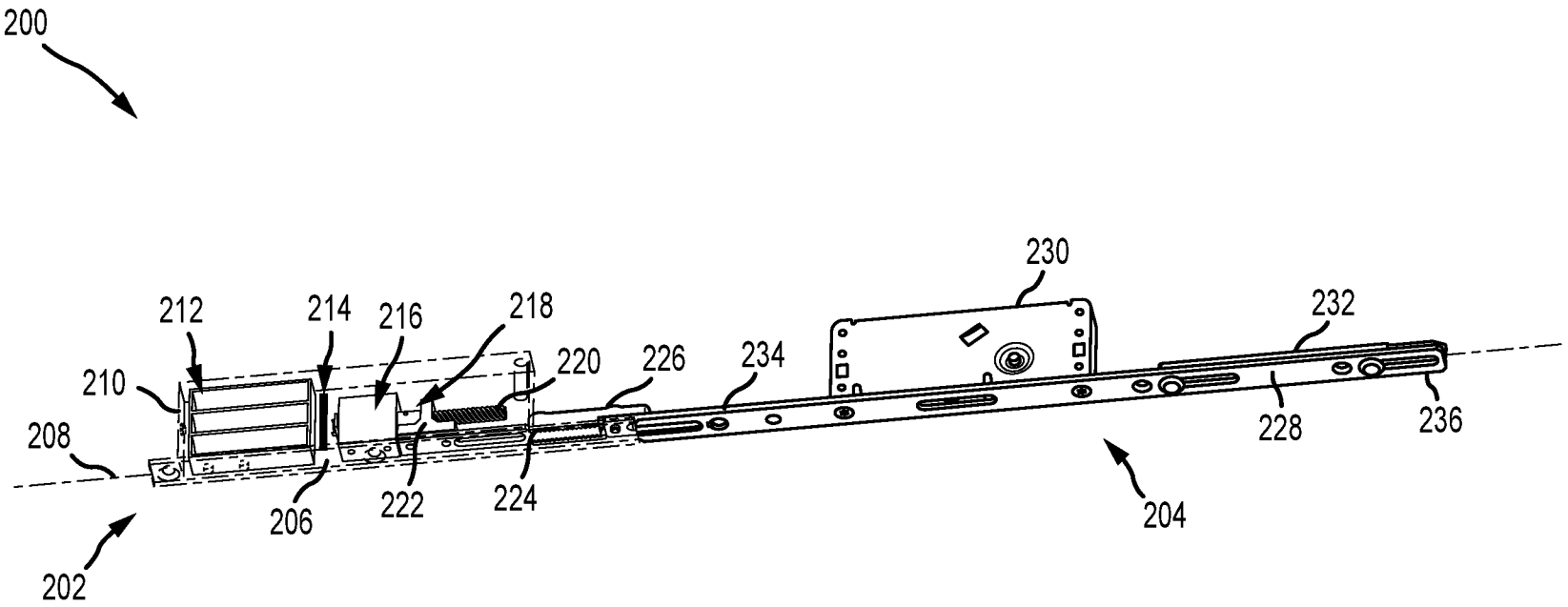
FIG. 2 is a perspective view of an exemplary electronic modular remote lock system.

FIG. 2 is a perspective view of an exemplary electronic modular remote lock system 200 for use with the door lock system 100 (shown in FIG. 1). In the example, the remote lock system 200 includes an electronic actuator assembly 202 that is coupled to a mechanical remote lock 204 for electronic actuation thereof. The electronic actuator assembly 202 is illustrated as transparent so as to show the components contained therein. The electronic actuator assembly 202 includes a first face plate 206 that defines a longitudinal axis 208. A housing 210 is positioned adjacent to and disposed on one side of the first face plate 206. The first face plate 206 is configured to mount on the edge of the door or door frame and recessed therein. Additionally, the first face plate 206 covers the housing 210 that is located within the door or door frame for aesthetic purposes and to restrict access to the components disposed within the housing 210.

Disposed within the housing 210, the actuator assembly 202 includes a power source 212 that is configured to provide power to a control system 214 and a motor 216. The control system 214 is communicatively coupled to the motor 216 and may include a circuit board (not shown) with any components that are configured to provide control and operation, including any wireless components to enable wireless operation of the actuator assembly 202 as described herein. For example, the control system 214 is configured to communicate wirelessly with the keeper sensor and/or remote panel and smartphone as described above in reference to FIG. 1 to receive signals and actuate the remote lock 204 as required or desired between a locked position and an unlocked position.

The motor 216 is coupled to a drive assembly 218 and is configured to drive actuation of the remote lock 204 as described herein. In the example, the drive assembly 218 includes a leadscrew 220 that is coupled to the motor 216, a nut 222 that is threadably engaged with the leadscrew 220, and a first drive bar 224 coupled to the nut 222 that extends along the longitudinal axis 208 and adjacent to the first face plate 206. The motor 216 may be a rotatory motor that drives rotation of the leadscrew 220 such that upon rotation, the first drive bar 224 may linearly move along the longitudinal axis 208 via the nut 222. A coupler assembly 226 may be used to couple the first drive bar 224 to the remote lock 204. The coupler assembly 226 is positioned on the same side of the first face plate 206 as the housing 210 such that the first face plate 206 can cover the coupler assembly 226 when mounted in a door or door frame for aesthetic purposes. The coupler assembly 226 is discussed further below in reference to FIG. 6. In the example, the electronic actuator assembly 202 replaces a typical mechanical linkage between the main lock assembly and the mechanical remote lock 204 in order to actuate the locking element therein.

The mechanical remote lock 204 may include a second face plate 228 that extends along the longitudinal axis 208 and which is aligned with the first face plate 206 of the actuator assembly 202. On one side of the second face plate 228, a lock housing 230 housing a first locking element 264 (shown in FIGS. 7A and 7B) and a second locking element 232 are disposed. The first and second locking elements are coupled together by a second drive bar 234 that is positioned adjacent to the second face plate 228. The second face plate 228 covers the lock housing 230, the second locking element 232, and the second drive bar 234 when mounted in a door or door frame for aesthetic purposes and to restrict access to the locking elements. In the example, the lock housing 230 may include the first locking element (not shown) that is configured to extend and retract from the second face plate 228 once actuated by the second drive bar 234. In one example, the first locking element may be a rhino hook extension. In other examples, the first locking element may be a flipper extension, a deadbolt extension, a mushroom extension, or any other type of extension as required or desired. The remote lock 204 also includes the second locking element 232 positioned at a tip 236 of the remote lock 204. In one example, the second locking element 232 may be shoot bolt extension. In other examples, only one of the first and second locking element may be utilized for the remote lock 204. Various configurations of the mechanical remote lock 204 are described further below in reference to FIGS. 7A-8C.

The remote lock 204 is coupled to the electronic actuator assembly 202 through the coupler assembly 226. More specifically, the first drive bar 224 is secured to the second drive bar 234 by the coupler assembly 226 so that the first drive bar 224 is adjacent to the second drive bar 234 along the longitudinal axis 208. As such, linear movement along the longitudinal axis 208 is translated between the first drive bar 224 and the second drive bar 234. This enables the motor 216 to move the drive bars 224, 234 along the longitudinal axis 208 between a first position, where the locking elements may be extended in a locked position, and a second position, where the locking elements are retracted in an unlocked position.

As illustrated in FIG. 2, the electronic actuator assembly 202 and the mechanical remote lock 204 are separate components that can be coupled together as required or desired so that the electronic actuator assembly 202 may be utilized to drive a number of different remote lock configurations. In alternative examples, the electronic actuator assembly 202 and the mechanical remote lock 204 may be manufactured as one unitary component. For example, the first and second face plates 206, 228 may be formed as a unitary face plate and/or the first and second drive bars 224, 234 may be formed as a unitary drive bar with the coupling assembly 226 not being required. As such, the lock system 200 is formed as a single component for installation within a door or door frame, with a single drive bar extending between the motor and the locking elements and covered by a single face plate.

Figure 3:
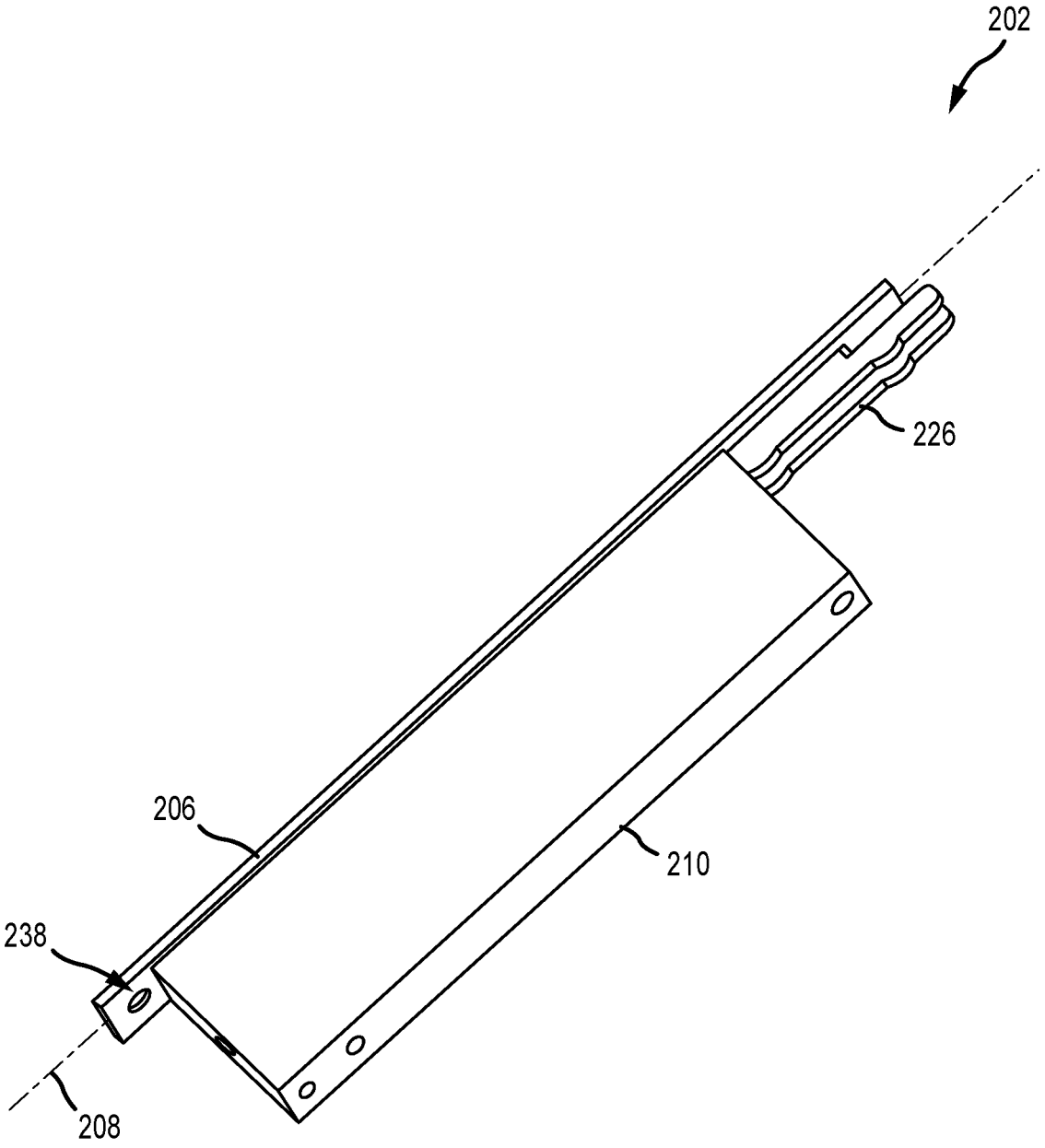
FIG. 3 is a perspective view of an electronic actuator assembly.

FIG. 3 is a perspective view of the electronic actuator assembly 202 with the mechanical remote lock not shown for clarity. The first face plate 206 extends along the longitudinal axis 208 and may define one or more openings 238 that are configured to receive screws (not shown) and secure the electronic actuator assembly 202 to a door or door frame. The housing 210 is coupled to one side of the first face plate 206 and is elongated along the longitudinal axis 208. As described above, the power source, motor, and drive assembly are disposed within the housing 210. The first drive bar (not shown) extends partially out of the housing 210 and is secured to the coupler assembly 226 that is used to operatively couple the electronic actuator assembly 202 to one or more mechanical remote locks.

Figure 4:
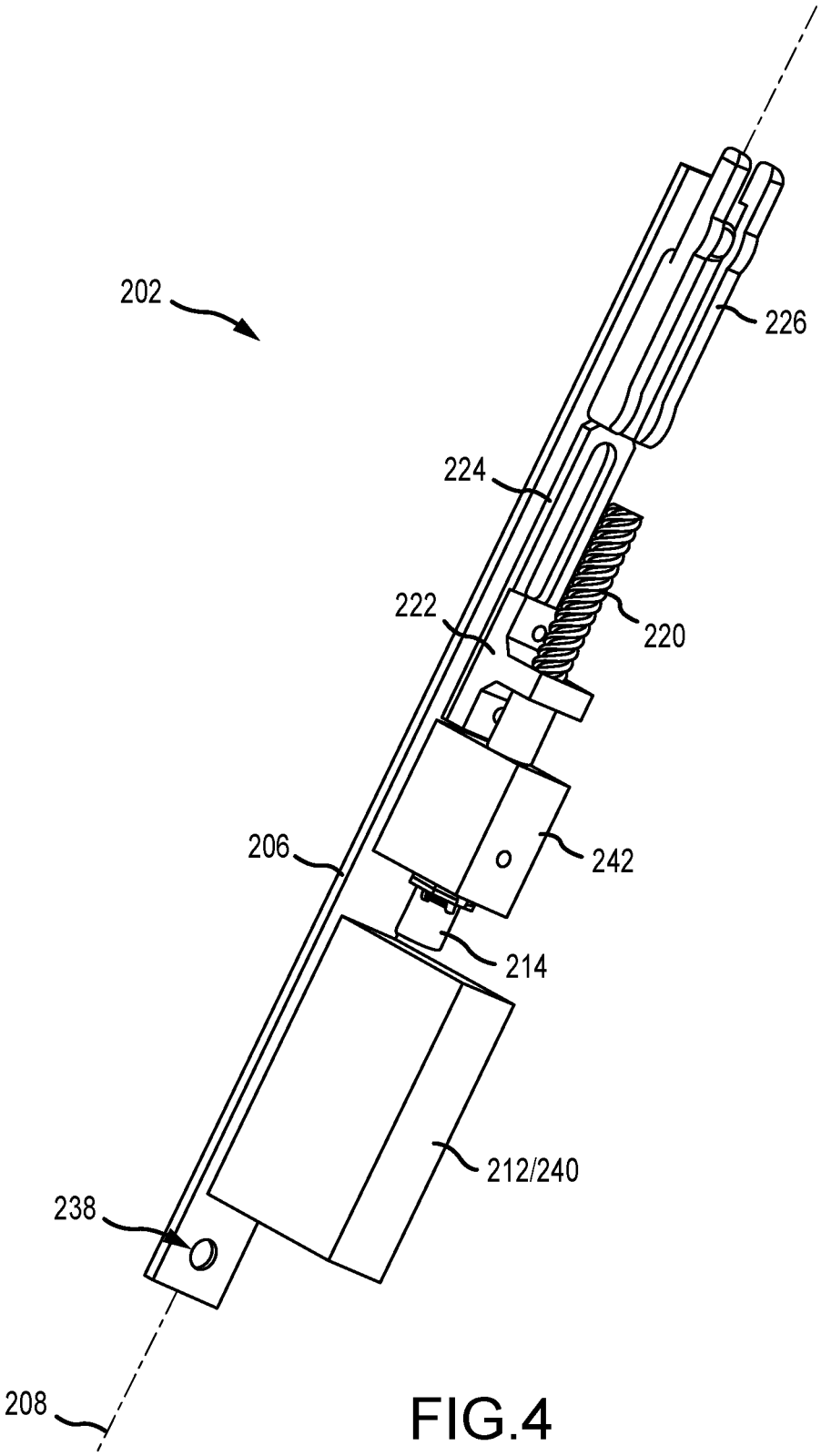
FIG. 4 is an interior perspective view of the electronic actuator assembly.
Figure 5:
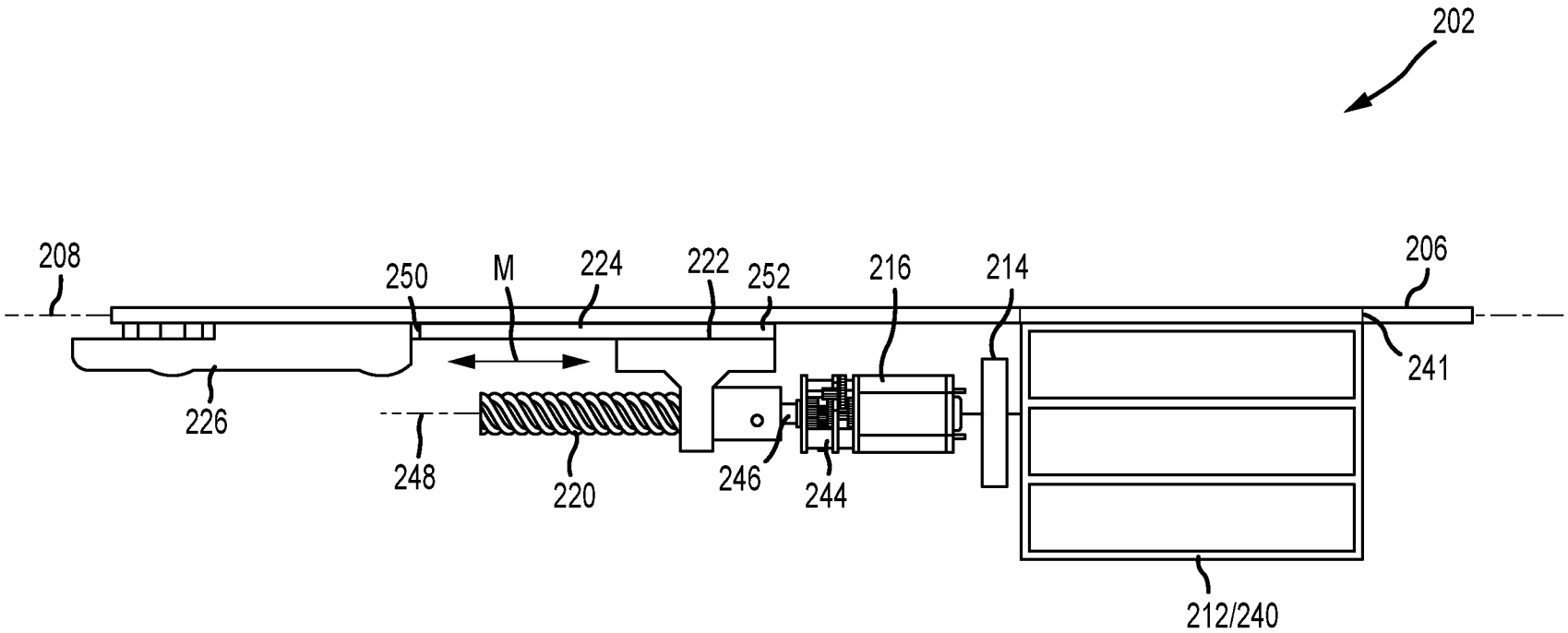
FIG. 5 is an interior side view of the electronic actuator assembly.

FIG. 4 is an interior perspective view of the electronic actuator assembly 202. FIG. 5 is an interior side view of the electronic actuator assembly 202. Referring concurrently to FIGS. 4 and 5, the housing of the electronic actuator assembly is removed for clarity. The power source 212 is disposed within the housing and may include a removable battery carrier 240 that includes a plurality of battery contacts (not shown) to enable electrical power to be provided to the control system 214 and the motor 216. In the example, the battery carrier 240 is sized and shaped to receive three "AA" batteries, although other battery types, arrangements, and power sources may be utilized. In other examples, the battery carrier 240 may be integral within the housing such that the battery contacts extend from the interior of the housing walls. The battery carrier 240 may be accessible through an opening 241 defined in the first face plate 206 and covered by a removable cover (not shown). In further examples, the electronic actuator assembly 202 may be coupled to line power within the building structure and the battery carrier 240 may be provided for back-up electric power.

The control system 214 is positioned between the battery carrier 240 and the motor 216, and within the housing such that the motor 216 is disposed on the other side of the control system 214 from the power source 212. The control system 214 may include a circuit board (not shown) that is configured to receive communication from the lock system as described in FIG. 1 and operationally control the motor 216 for actuating the remote locks. The control system 214 is communicatively coupled to the motor 216 that is housed in a motor housing 242 (shown in FIG. 4). The motor 216 may be an off-the-shelf unit that includes an integral gear set 244 that drives rotation of a shaft 246 that is coupled to the leadscrew 220. The motor 216 may be a rotary motor that is configured to drive the leadscrew 220 in both a clockwise and counter-clockwise rotational direction so as to extend and retract the locking elements of the remote lock as described above. In other examples, a solenoid may be used in place of the motor 216 to converts energy (e.g., from the power source 212) into linear motion of the first drive bar 224.

The leadscrew 220 is threadably engaged with the nut 222 that connects the leadscrew 220 to the first drive bar 224. As such, rotation of the leadscrew 220 about a rotational axis 248 is translated into linear movement M of the first drive bar 224 and thereby actuation of the remote lock. Accordingly, rotation of the leadscrew 220 can extend and retract one or more locking mechanisms from the remote lock. The first drive bar 224 includes a first end 250 and an opposite second end 252. The first end 250 is configured to be secured to the second drive bar of the mechanical remote lock by the coupler assembly 226. The second end 252 is coupled to the nut 222 such that rotation of the nut 222 is restricted and linear movement M of the nut 222 is enabled upon rotation of the leadscrew 220.

The electronic actuator assembly 202 is constructed and configured in a manner that reduces overall space, eases installation (even by untrained purchasers), for example, through use of a standard size drill bit, and limits end-user access to critical internal components. With regard to reducing space, the elongate elements of the actuator assembly 202 are configured so as to have parallel axes. For example, the leadscrew 220, the motor 216, the control system 214, and the power source 212 are all axially aligned along the rotational axis 248 of the leadscrew 220. By axially arranging these elongate elements, the size of the housing may be reduced, which reduces overall size of the actuator assembly 202 and the space that it occupies. In the example, the rotational axis 248 of the leadscrew 220 is substantially parallel to and offset from the longitudinal axis 208 of the first face plate 206.

Figure 6:
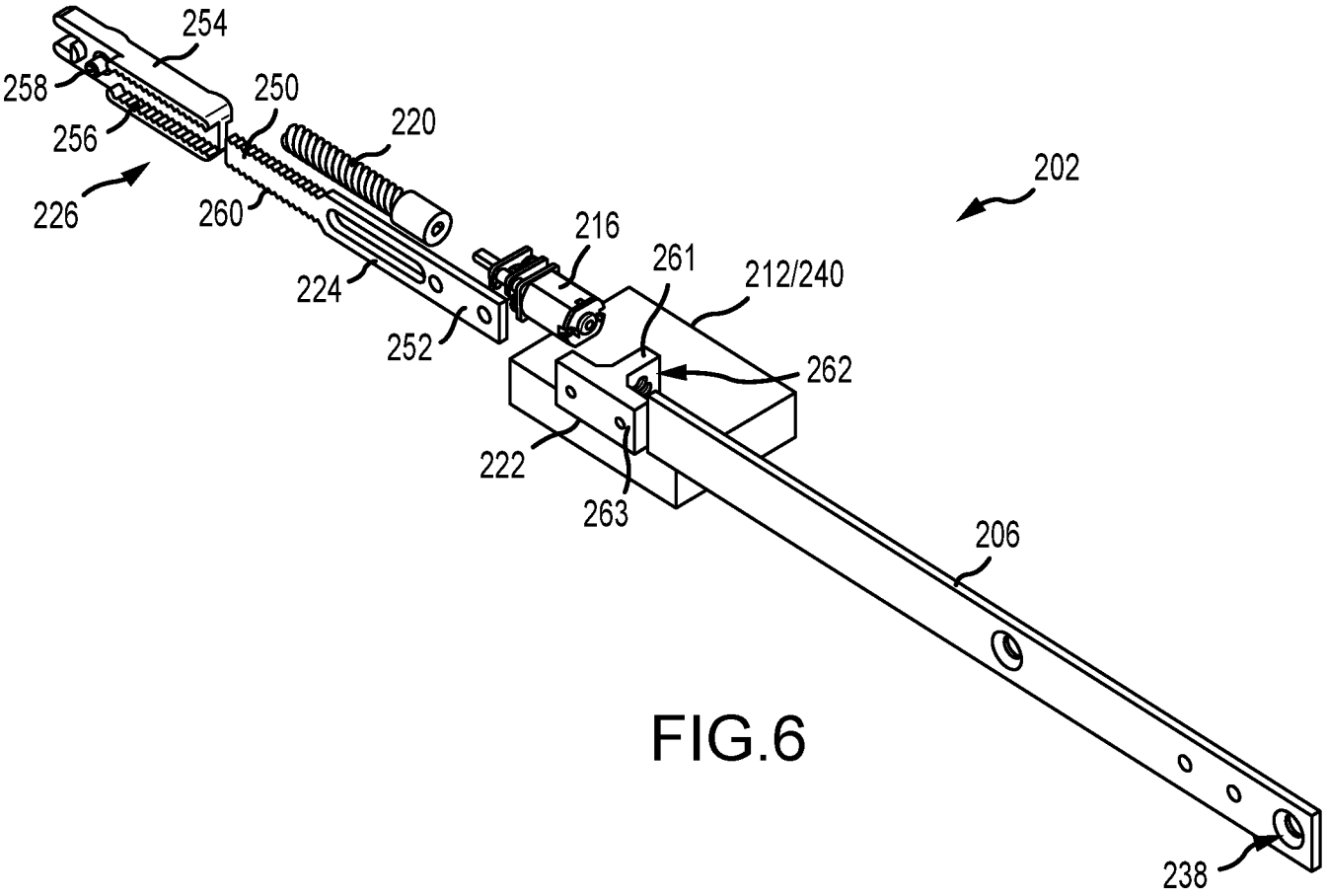
FIG. 6 is an exploded perspective view of the interior of the electronic actuator assembly.

FIG. 6 is an exploded perspective view of the interior of the electronic actuator assembly 202. In the example, the coupler assembly 226 may include a mounting bracket 254 that is configured to connect between the second drive bar of the remote lock (not shown) and the first drive bar 224 of the actuator assembly 202 such that the motor 216 can drive actuation of the remote lock. The mounting bracket 254 includes at least one rack 256 defined on one end to secure the first drive bar 224 and at least one projection 258 defined on the opposite end to secure the second drive bar. The first end 250 of the first drive bar 224 includes at least one corresponding rack 260 so that the first drive bar 224 can be secured to the mounting bracket 254. The racks 256, 260 are configured to enable the length of the coupler assembly 226 and the first drive bar 224 to be adjustable along the longitudinal axis and enable accommodation of different mechanical remote locks. The projection 258 is sized and shaped to extend through a corresponding aperture 266 (shown in FIG. 7A) of the second drive bar of the remote lock. In alternative examples, the mounting bracket 254 may use any other connection method as required or desired to couple the drive bars together and enable linear movement to be translated therebetween.

In the example, the nut 222 may be substantially T-shaped with a leg 261 having a threaded opening 262 to receive and engage with the leadscrew 220. A cross-member 263 of the nut 222 is secured to the second end 252 of the first drive bar 224 such that rotation is restricted and the first drive bar 224 is moveable along the longitudinal axis upon rotation of the leadscrew 220. In alternative examples, the nut 222 may be configured to connect to a rod that is concealed in the door edge. The rod can drive shoot bolts at the head or sill and keeps the multipoint lock system hidden within the door. In other examples, the nut 222 has any other configuration that enables rotational movement of the leadscrew 220 to be translated into linear movement of the first drive bar 224.

By coupling the electronic actuator assembly 202 to a mechanical remote lock (e.g., via the coupler assembly 226), the need for mechanical linkage extending to the remote lock from the main lock assembly is eliminated, thereby significantly simplifying multi-point lock systems on doors or door frames. The door height and handle location are no longer variables in installing the multi-point lock system. Additionally, the actuator assembly 202 is versatile and can be configured to be used with a variety of remote locks and can be mounted at any location of the door. Furthermore, the electronic actuator assembly 202 enables the mechanical remote lock to be utilized with a security system or remote computers as described in reference to FIG. 1.

Figure 7A:
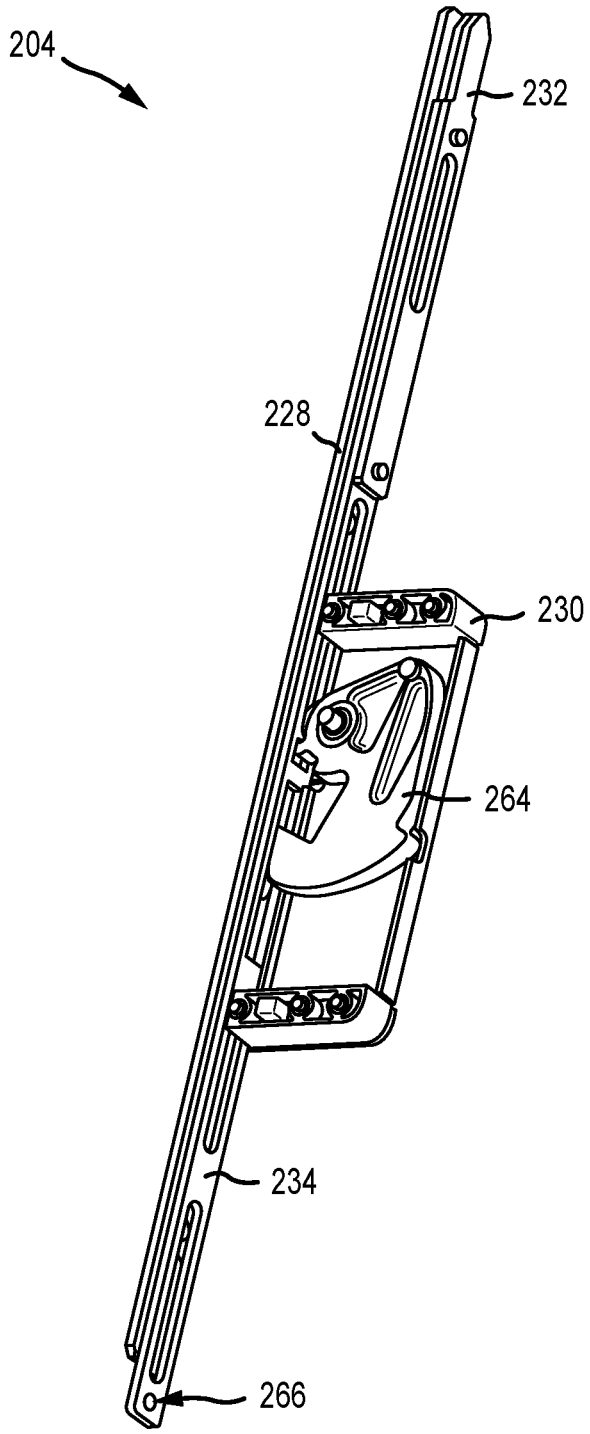
FIG. 7A is a perspective view of a mechanical remote lock in an unlocked position.

FIG. 7A is a perspective view of the mechanical remote lock 204 in an unlocked position. A portion of the lock housing 230 is removed so that the first locking element 264 may be illustrated. In the unlocked position, the second drive bar 234 is positioned so that both the first and second locking elements 264, 232 are retracted within the remote lock 204. The second drive bar 234 includes an aperture 266 that is configured to secure to the coupling assembly 226 (shown in FIG. 7B) so that the second drive bar 234 is actuatable by the motor of the electronic actuator assembly as described above. The remote lock 204 that is illustrated is manufactured by Amesbury Group, Inc., as a multi-point lock accessory having a rhino hook and shoot tip.

Figure 7B:
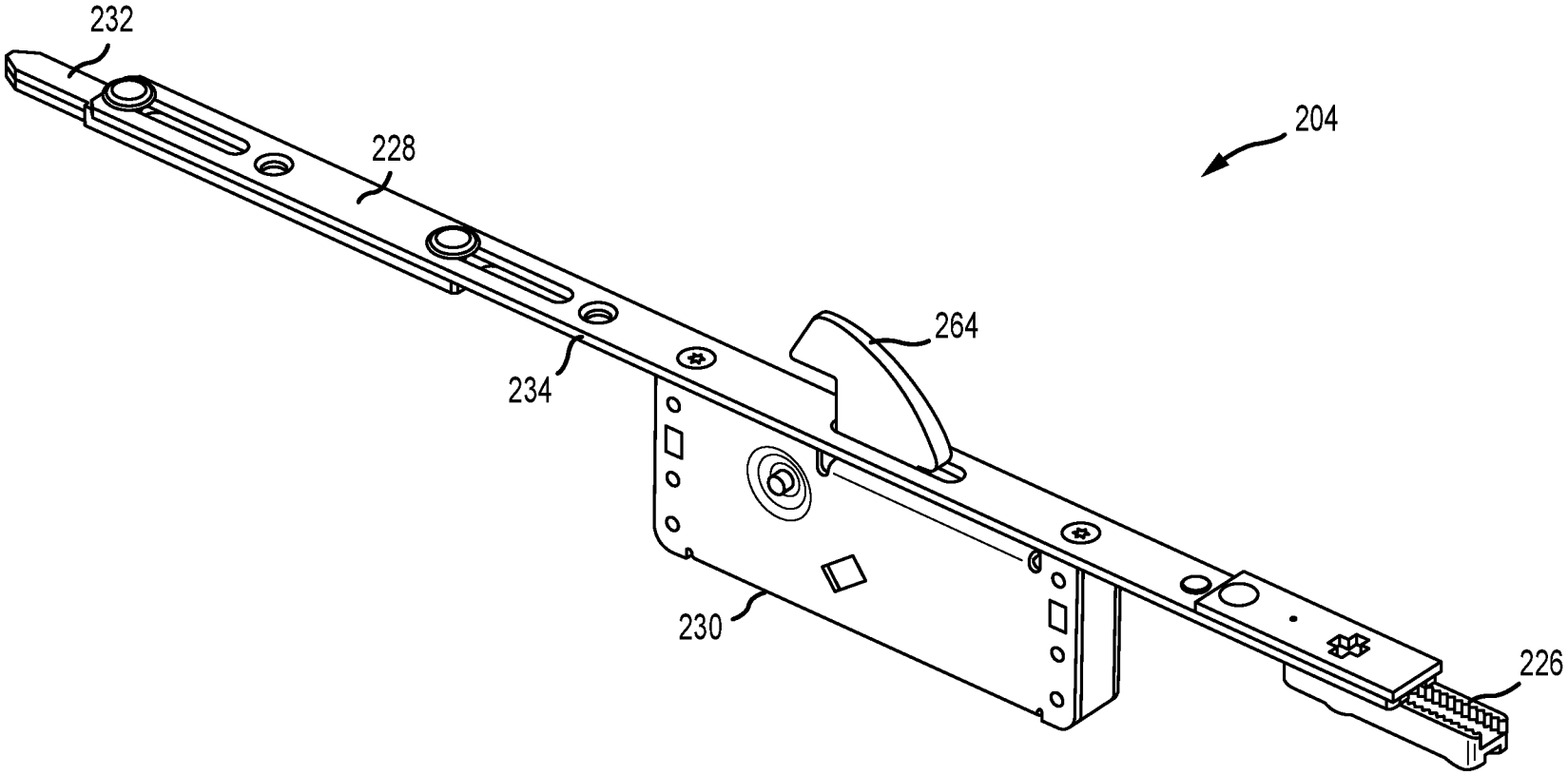
FIG. 7B is a perspective view of the mechanical remote lock in a locked position.

FIG. 7B is a perspective view of the mechanical remote lock 204 in a locked position. When the second drive bar 234 is actuated by the electronic actuator assembly and is moved linearly, both of the first and second locking elements 264, 232 are extended from the remote lock 204.

Figure 8A:
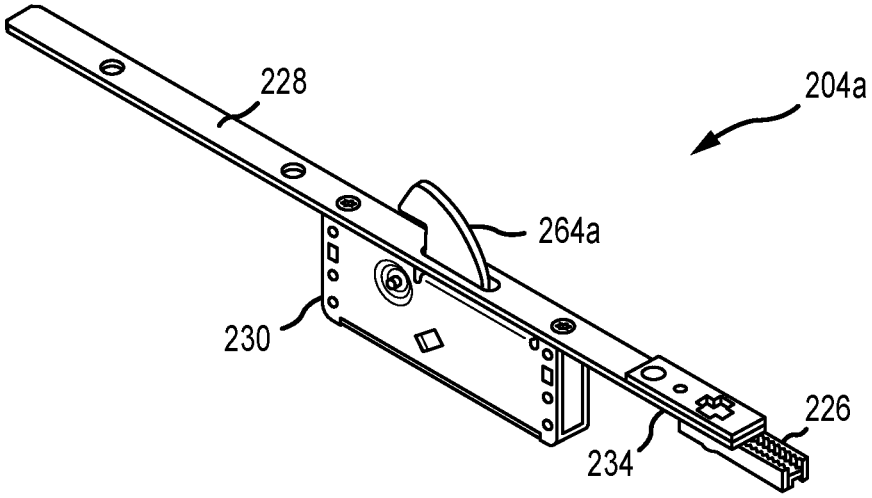
FIG. 8A-8C are perspective views of additional mechanical remote locks.
Figure 8B:
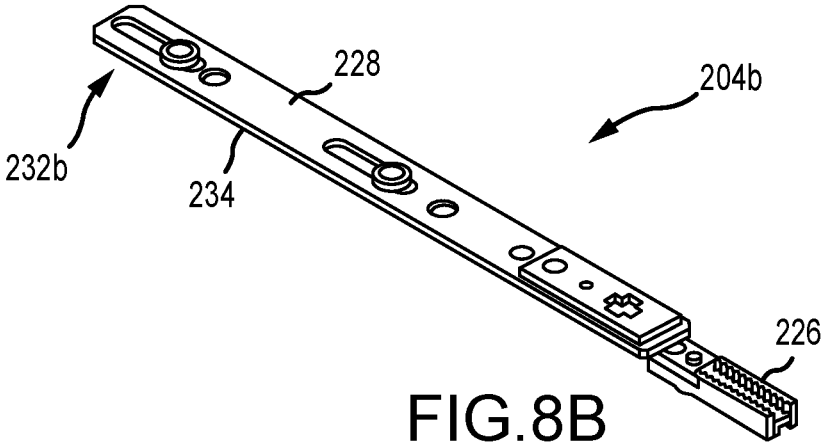
Figure 8C:
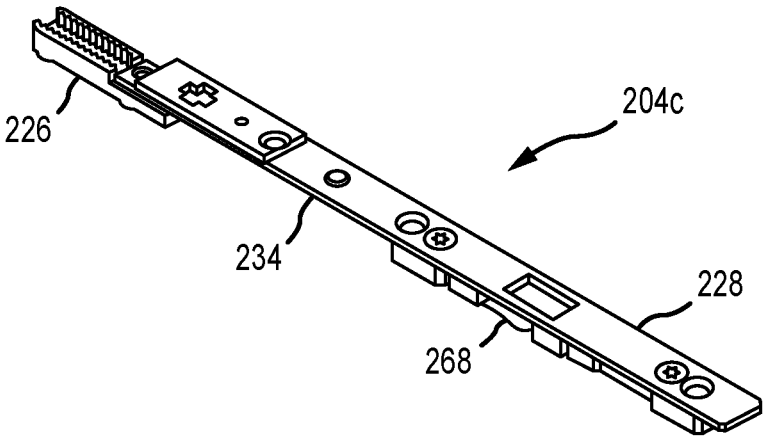

FIG. 8A-8C are perspective views of additional mechanical remote locks 204*a-c* that may be used with the electronic actuator assembly described above. Certain components are described above, and as such, are not necessarily described further. Additionally, the remote locks that are illustrated may be manufactured by Amesbury Group, Inc., as various multi-point lock accessories, however, the electronic actuator assembly may enable use of any other mechanical remote locks as required or desired. FIG. 8A illustrates a mechanical remote lock 204*a* with only a rhino hook locking element 264*a*. FIG. 8B illustrates a mechanical remote lock 204*b* with only a shoot bolt extension 232*b*. FIG. 8C illustrates a mechanical remote lock 204*c* with a flipper extension 268.

Figure 9:
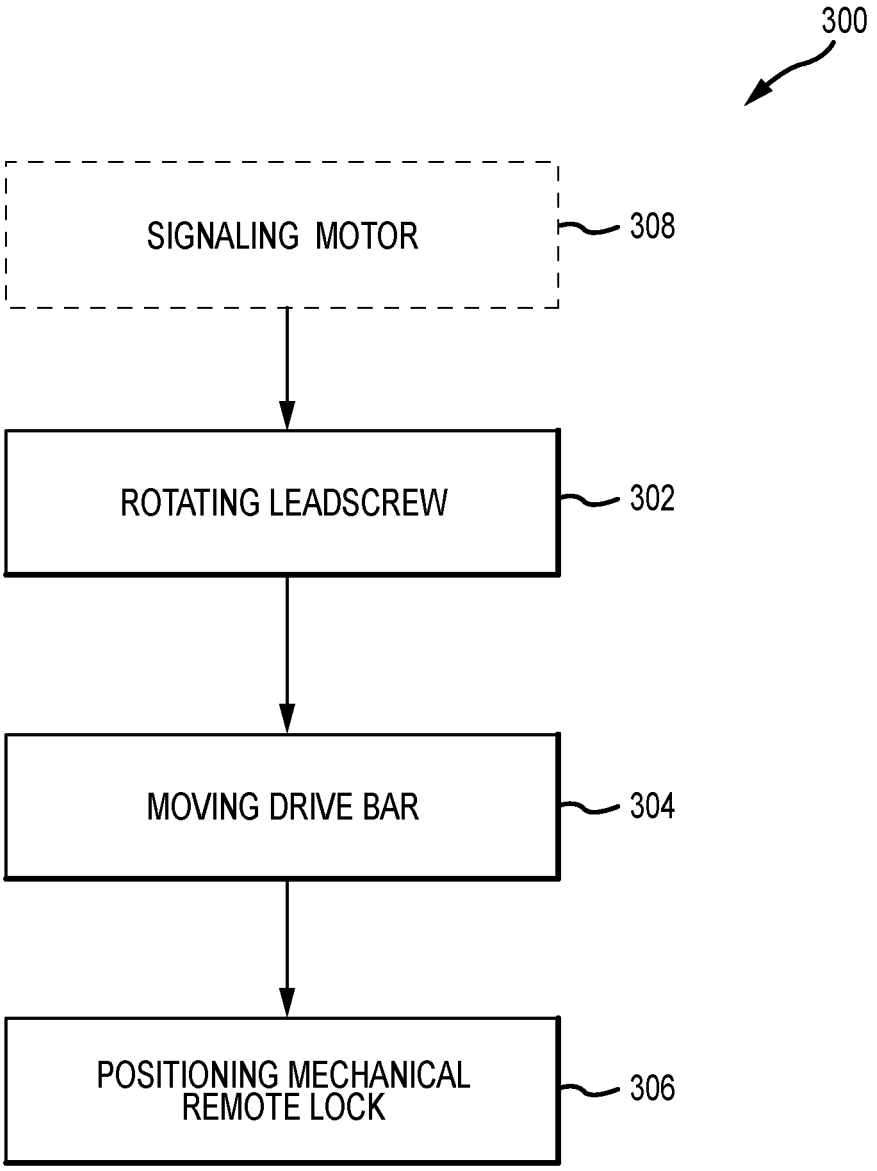
FIG. 9 is a flowchart illustrating an exemplary method of actuating a mechanical remote lock assembly.

FIG. 9 is a flowchart illustrating an exemplary method 300 of actuating a mechanical remote lock assembly. In this example, the method 300 may include rotating a leadscrew via a motor (operation 302), where a drive bar is coupled to the leadscrew by a threaded nut. In combination with rotating the leadscrew, the drive bar linearly moves (operation 304) along a longitudinal axis, where the drive bar is coupled to the mechanical remote lock assembly. The mechanical remote lock assembly can then be selectively positioned (operation 306) between a lock position and an unlock position via the linear movement of the drive bar. In some examples, before rotating the leadscrew, the method 300 includes signaling the motor upon detection of a deadbolt relative to a keeper sensor (operation 308).

The materials utilized in the manufacture of the lock described herein may be those typically utilized for lock manufacture, e.g., zinc, steel, aluminum, brass, stainless steel, etc. Molded plastics, such as PVC, polyethylene, etc., may be utilized for the various components. Material selection for most of the components may be based on the proposed use of the locking system. Appropriate materials may be selected for mounting systems used on particularly heavy panels, as well as on hinges subject to certain environmental conditions (e.g., moisture, corrosive atmospheres, etc.).

Any number of features of the different examples described herein may be combined into one single example and alternate examples having fewer than or more than all the features herein described are possible. It is to be understood that terminology employed herein is used for the purpose of describing particular examples only and is not intended to be limiting. It must be noted that, as used in this specification, the singular forms "a," "an," and "the" include plural referents unless the context clearly dictates otherwise.

While there have been described herein what are to be considered exemplary and preferred examples of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. An electronic remote lock actuator comprising:

a face plate defining a longitudinal axis;

a housing disposed adjacent to the face plate;

a motor disposed in the housing;

a first drive bar adjacent the face plate and configured to be linearly moveable along the longitudinal axis relative to the face plate by the motor, wherein the first drive bar comprises a first end and an opposite second end, the first end comprising at least one first rack and the second end configured to couple to the motor; and a coupler assembly comprising at least one second rack defined on one end and at least one projection defined on an opposite end, wherein the at least one second rack adjustably couples to the at least one first rack of the first end of the first drive bar external of the housing and the at least one projection is configured to be secured to a second drive bar of a mechanical remote lock assembly, wherein the first drive bar is adjacent the second drive bar along the longitudinal axis such that linear movement of the first drive bar is translated to substantially parallel linear movement of the second drive bar along the longitudinal axis, and wherein the at least one second rack of the coupler assembly is adjustably positionable on the at least one first rack of the first end of the first drive bar along the longitudinal axis.

2. The electronic remote lock actuator of claim 1, further comprising a nut coupled to the second end of the first drive bar and a leadscrew coupled to the motor, wherein the nut is threadably engaged with the leadscrew such that upon rotation of the leadscrew by the motor, the first drive bar linearly moves along the longitudinal axis.

3. The electronic remote lock actuator of claim 2, wherein a rotational axis of the leadscrew is substantially parallel to the longitudinal axis.

4. The electronic remote lock actuator of claim 1, further comprising a battery carrier configured to contain a power source, wherein the batter carrier is removably disposable within the housing.

5. The electronic remote lock actuator of claim 1, wherein the mechanical remote lock assembly comprises at least one of a flipper extension, a shoot bolt extension, a rhino hook extension, and a deadbolt extension.

6. The electronic remote lock actuator of claim 1, wherein the motor comprises a rotatory motor, and wherein rotational movement of the rotatory motor is configured to be translated into linear movement of the first drive bar.

7. A remote lock system comprising:

a housing;

a drive bar defining a longitudinal axis, wherein the drive bar comprises a first drive bar and a second drive bar, the first drive bar adjacent to the second drive bar along the longitudinal axis, and wherein at least a portion of the first drive bar comprises at least one first rack that extends from the housing and is slidably movable relative to the housing;

an electronic actuator disposed within the housing and comprising a motor coupled to the first drive bar and configured to linearly move the first drive bar along the longitudinal axis;

a coupler assembly configured to secure the first drive bar to the second drive bar, wherein the coupler assembly comprises at least one second rack configured to adjustably secure to the at least one first rack of the first drive bar defined on one end and at least one projection configured to secure to the second drive bar defined on the opposite end, and wherein the at least one second rack of the coupler assembly is adjustably positionable on the at least one first rack of the first drive bar along the longitudinal axis; and a mechanical remote lock assembly coupled to the second drive bar, the mechanical remote lock assembly comprising at least one locking element, wherein the at least one locking element is disposed remotely from the housing, and wherein upon linear movement of the drive bar by the motor, the mechanical remote lock assembly actuates between a lock position and an unlock position.

8. The remote lock system of claim 7, wherein the electronic actuator further comprises a face plate disposed adjacent to the housing.

9. The remote lock system of claim 7, wherein the electronic actuator further comprises:

a leadscrew coupled to the motor and rotatable about a rotational axis by the motor; and a nut threadably engaged with the leadscrew and coupled to the drive bar, wherein upon rotation of the leadscrew by the motor, the drive bar linearly moves along the longitudinal axis via the nut.

10. The remote lock system of claim 9, wherein the rotational axis is substantially parallel to the longitudinal axis.

11. The remote lock system of claim 7, wherein the electronic actuator further comprises a removable power source.

12. The remote lock system of claim 7, wherein the mechanical remote lock assembly comprises at least one of a flipper extension, a shoot bolt extension, a rhino hook extension, and a deadbolt extension.

* * * * *